US012800274B2

(12) United States Patent
Coryell et al.

(10) Patent No.: US 12,800,274 B2
(45) Date of Patent: Nov. 17, 2026

(54) HANDHELD SHOOTING TARGET THROWER

(71) Applicant: AOB Products Company, Columbia, MO (US)

(72) Inventors: Paul Coryell, Columbia, MO (US); Michael Cottrell, Ashland, MO (US); Michael Lindsay, Columbia, MO (US); Tim Meissen, Columbia, MO (US); Brittany Niemeyer, Auxvasse, MO (US); Shane Ball, Columbia, MO (US); Justin Burke, Columbia, MO (US); Jarrod Grove, Columbia, MO (US); Timothy S. Kinney, Warrenton, MO (US); Ryan Donahue, Columbia, MO (US); Ryan Varnum, Columbia, MO (US)

(73) Assignee: AOB Products Company, Columbia, MO (US)

( * ) Notice: Subject to any disclaimer, the term of this patent is extended or adjusted under 35 U.S.C. 154(b) by 620 days.

(21) Appl. No.: 18/091,630

(22) Filed: Dec. 30, 2022

(65) Prior Publication Data

US 2023/0213318 A1 Jul. 6, 2023

Related U.S. Application Data

(60) Provisional application No. 63/306,764, filed on Feb. 4, 2022, provisional application No. 63/266,193, filed on Dec. 30, 2021.

(51) Int. Cl.
*F41J 9/22* (2006.01)

(52) U.S. Cl.
CPC ..... *F41J 9/22* (2013.01)

(58) Field of Classification Search
CPC . F41J 9/18; F41J 9/20; F41J 9/22; F41J 9/28; F41B 7/08; A63H 33/18; A65B 65/10; A63B 65/10

(Continued)

(56) References Cited

U.S. PATENT DOCUMENTS 66,048 A * 6/1867 Fitzgerald ..... F41B 7/00 124/26
1,186,098 A * 6/1916 Horst ..... F41B 3/00 124/5

(Continued)

FOREIGN PATENT DOCUMENTS

CN 204240867 U 4/2014
CN 214582808 U 11/2021

(Continued)

OTHER PUBLICATIONS

U.S. Pat. No. 252,230 for Target Trap, Issued Jan. 10, 1882, G. Ligowsky, 3 pages.

(Continued)

*Primary Examiner* — Alexander R Niconovich
(74) *Attorney, Agent, or Firm* — Stinson LLP

(57) ABSTRACT

A handheld clay thrower assembly, components thereof, and associated methods. The handheld clay thrower assembly includes a frame, a thrower, a cocking mechanism, and a firing mechanism. In some embodiments, the handheld clay thrower includes a shoulder rest and a pistol grip permitting the clay thrower to be shouldered, aimed, and fired like a firearm. A target to be thrown is inserted in the thrower assembly through an inlet opening and fired out of an exit opening.

30 Claims, 12 Drawing Sheets

(58) Field of Classification Search
USPC ..... 124/5, 6, 7, 8, 36, 43
See application file for complete search history.

(56) References Cited

U.S. PATENT DOCUMENTS 1,332,992 A 3/1920 Moore et al.
1,353,663 A * 9/1920 Napier ..... F41J 9/18 124/43
1,374,757 A * 4/1921 Napier ..... F41J 9/20 248/183.3
1,376,825 A * 5/1921 Napier ..... F41J 9/18 124/32
1,475,713 A 11/1923 Napier
1,499,845 A * 7/1924 Spangler ..... F41J 9/20 124/43
1,663,780 A 3/1928 Spangler
1,700,880 A * 2/1929 Camp ..... F41J 9/28 124/5
1,979,502 A 11/1934 Suteliffe
2,078,166 A * 4/1937 Schwerin ..... F41J 9/20 124/43
2,122,984 A * 7/1938 Loomis ..... F41J 9/28 D21/720
2,135,603 A * 11/1938 Roth ..... F41J 9/20 124/32
2,158,739 A * 5/1939 Bingham, Jr. ..... F41J 9/20 124/40
2,193,266 A * 3/1940 Betts ..... F41J 9/20 124/8
2,245,258 A * 6/1941 Darrell ..... F41J 9/24 124/8
2,279,857 A 4/1942 Bodnar
2,430,077 A * 11/1947 Razee ..... F41J 9/20 124/36
2,432,446 A 12/1947 Rutherford et al.
2,455,661 A 12/1948 Pont
2,531,613 A * 11/1950 Darrell ..... F41J 9/30 124/47
2,586,547 A * 2/1952 Marley ..... F41J 9/28 124/43
2,626,596 A 1/1953 Lyon
2,666,424 A * 1/1954 Foster ..... F41J 9/32 124/43
2,711,163 A 6/1955 Richardson
2,925,812 A * 2/1960 Foster ..... F41J 9/30 124/43
2,994,313 A * 8/1961 Grahn ..... F41J 9/26 124/36
3,070,082 A * 12/1962 Foster ..... F41J 9/20 124/8
3,093,127 A * 6/1963 Starr ..... F41J 9/30 124/32
3,130,717 A * 4/1964 Moinil ..... F41J 9/18 124/1
3,179,101 A * 4/1965 Luebkeman ..... F41J 9/20 124/43
3,233,517 A 2/1966 Morrison
3,368,542 A 2/1968 Dale
3,515,114 A * 6/1970 Carbonneau ..... F41B 7/006 124/52
3,533,392 A * 10/1970 Luebkeman ..... F41J 9/20 124/43
3,552,371 A 1/1971 Kahelin
3,601,112 A * 8/1971 Dale ..... F41J 9/20 124/80
3,605,715 A 9/1971 Welboum
3,612,025 A 10/1971 Rhodes
3,677,257 A 7/1972 Segerkvist
3,695,247 A * 10/1972 Tucker ..... F41J 9/18 124/35.1
3,717,136 A * 2/1973 Gay et al. ..... F41B 7/08 473/588
3,722,495 A 3/1973 Schreiner
3,821,945 A 7/1974 Foster
3,826,238 A 7/1974 Hansen
3,880,135 A * 4/1975 Martin ..... F41J 9/22 124/43
3,923,033 A 12/1975 LaPorte et al.
3,937,203 A 2/1976 Riedmueller et al.
3,971,357 A 7/1976 aPorte et al.
4,005,965 A 2/1977 Alday et al.
4,014,310 A 3/1977 LaPorte et al.
4,015,578 A 4/1977 Wright
4,146,007 A * 3/1979 Alday ..... F41J 9/30 124/43
4,146,008 A * 3/1979 Rowlands ..... F41J 9/18 124/43
4,220,130 A * 9/1980 Glover ..... A63B 69/408 124/36
4,248,202 A * 2/1981 Jaworski ..... F41B 7/08 124/16
4,300,520 A 11/1981 LaPorte et al.
4,481,932 A 11/1984 Olson
4,699,116 A 10/1987 Freeland et al.
4,706,641 A 11/1987 Cote et al.
4,784,107 A 11/1988 Kelly
4,831,996 A * 5/1989 Cero ..... F41J 9/24 74/2
4,852,543 A 8/1989 Mosser
4,976,249 A * 12/1990 Gagnon ..... F41J 9/22 124/36
5,050,575 A * 9/1991 Killion ..... F41B 7/08 124/8
5,226,622 A 7/1993 Leana
5,345,922 A 9/1994 Ott
5,427,380 A 6/1995 Hazard et al.
5,470,078 A 11/1995 Conlan
5,579,750 A * 12/1996 Lease ..... F41B 3/02 124/21
5,605,139 A * 2/1997 Orwoll ..... F41J 9/22 124/8
5,704,341 A 1/1998 Ritzenthaler
5,720,664 A * 2/1998 Brubacher ..... F41A 33/02 273/362
5,937,839 A 8/1999 Nilsson et al.
5,970,969 A 10/1999 Anttila et al.
6,062,207 A * 5/2000 Underhill ..... F41J 9/20 124/8
6,159,112 A * 12/2000 Ciluffo ..... A63B 69/0026 124/4
6,655,370 B1 * 12/2003 Beckwith ..... F41B 3/005 124/16
7,066,365 B2 6/2006 Brown
7,086,192 B2 8/2006 Deros
7,263,986 B2 9/2007 Lovel
7,427,069 B2 9/2008 Bateman et al.
7,461,645 B2 * 12/2008 Williamson ..... F41J 9/18 124/20.1
8,196,504 B2 6/2012 Keng
8,276,573 B2 10/2012 Skell et al.
8,657,167 B2 2/2014 Horyna et al.
8,919,331 B2 12/2014 Rennert
8,943,945 B1 * 2/2015 Collins ..... F41J 9/20 124/16
8,967,130 B2 * 3/2015 Victor ..... F41B 7/08 124/16
9,005,055 B2 4/2015 Gonzalez
9,194,646 B2 * 11/2015 Victor ..... F41B 7/08
9,303,942 B2 * 4/2016 Sievers ..... F41B 3/005
9,389,050 B1 7/2016 Chen
9,417,026 B2 8/2016 Ricke
9,441,923 B2 9/2016 Chadwick
9,605,931 B2 * 3/2017 Laporte ..... F41J 9/20
9,726,447 B2 8/2017 Fridman et al.
9,835,421 B2 * 12/2017 Laporte ..... F41J 9/18
10,088,282 B2 10/2018 LaPorte et al.
10,323,914 B2 6/2019 Muller et al.
10,365,072 B1 7/2019 Liu
10,458,760 B1 * 10/2019 Liu ..... F41J 9/20
10,545,011 B1 * 1/2020 Collins ..... F41J 9/18
10,603,568 B2 3/2020 Palanethra et al.

(56) References Cited

U.S. PATENT DOCUMENTS

| | | | | |
|---|---|---|---|---|
| 10,690,458 | B2 * | 6/2020 | Laporte | F41J 9/30 |
| 10,746,513 | B1 * | 8/2020 | Liu | F41J 9/24 |
| 10,859,349 | B1 | 12/2020 | Liu | |
| 11,015,896 | B1 * | 5/2021 | Hochberg | A63B 69/406 |
| 11,052,300 | B1 * | 7/2021 | Shie | A63B 69/406 |
| 11,077,353 | B1 | 8/2021 | Kamstra et al. | |
| 11,137,233 | B1 | 10/2021 | Liu | |
| 11,428,510 | B2 | 8/2022 | Arnold et al. | |
| 11,441,879 | B1 * | 9/2022 | Dunning | F41J 9/24 |
| 11,562,158 | B2 | 1/2023 | Schmitz | |
| 11,617,934 | B2 * | 4/2023 | Shirley | A63B 69/0026 124/8 |
| 11,680,779 | B2 * | 6/2023 | Dunning | F41J 9/24 124/16 |
| 11,740,059 | B2 * | 8/2023 | Laporte | F41J 9/24 124/8 |
| 11,885,599 | B2 * | 1/2024 | Coryell | F41J 9/22 |
| 11,920,908 | B2 * | 3/2024 | Arnold | F41J 9/18 |
| 2005/0263962 | A1 | 12/2005 | Roh et al. | |
| 2007/0023022 | A1 | 2/2007 | Lentz | |
| 2012/0138034 | A1 * | 6/2012 | Whidborne | F41J 9/18 124/8 |
| 2014/0311470 | A1 | 10/2014 | Sievers | |
| 2015/0204638 | A1 | 7/2015 | Frazier | |
| 2017/0052003 | A1 * | 2/2017 | Liu | F41J 9/18 |
| 2017/0176151 | A1 | 6/2017 | Liu | |
| 2018/0180390 | A1 | 6/2018 | Muller et al. | |
| 2021/0372742 | A1 | 12/2021 | Arnold | |
| 2021/0372743 | A1 | 12/2021 | Arnold et al. | |
| 2021/0381810 | A1 * | 12/2021 | Laporte | F41J 9/24 |
| 2022/0018637 | A1 | 1/2022 | Wright et al. | |
| 2022/0205764 | A1 * | 6/2022 | Laporte | F41J 9/30 |
| 2022/0325990 | A1 | 10/2022 | LaPorte et al. | |
| 2022/0349683 | A1 * | 11/2022 | Laporte | F41J 9/18 |
| 2022/0412703 | A1 | 12/2022 | Dunning et al. | |
| 2025/0123086 | A1 * | 4/2025 | Jennings | F41J 9/22 |

FOREIGN PATENT DOCUMENTS

| | | | |
|---|---|---|---|
| CN | 217442401 | U | 9/2022 |
| KR | 20130025779 | A | 3/2013 |
| WO | 2010149993 | A2 | 12/2010 |

OTHER PUBLICATIONS

U.S. Pat. No. 806,663 for Target Throwing Trap, Issued Dec. 5, 1905, F. Hardy, 9 pages.

U.S. Pat. No. 829,963 for Target-Trap, Issued Sep. 4, 1906, J. Haughawout, 7 pages.

Allen Company, Claymaster Sporting Clay Target Thrower, Amazon Product Description, downloaded Apr. 17, 2023, www.amazon.com, 6 pages.

Atlas Trap Company, AT 400, Safe Operating Manual, Not Dated, downloaded Apr. 17, 2023, www.atlastraps.com, 6 pages.

Atlas Trap Company, ATA AT-400 Commercial Series, Catalog Description, downloaded Apr. 17, 2023, htpps://www.atlastraps.com/ATA-AT-400-Commercial-Series_p_46.html, 2 pages.

Atlas Trap Company, Model: Hare, Safe Operating Manual, Not Dated, downloaded Apr. 17, 2023, www.atlastraps.com, 8 pages.

Atlas Trap Company, Hare:Rabbit, Catalog Description, downloaded Apr. 17, 2023, htpps://www.atlastraps.com/Hare-Rabbit-_p_120.html, 3 pages.

Atlas Trap Company, Rabbit Models Trap Machines, Catalog Description, downloaded Apr. 17, 2023, htpps://www.howelltraps.com/atlas-rabbit-clay-target-throwing-trap-machines.html, 3 pages.

Birchwood Casey, WingOne Ultimate Handheld Clay Target Thrower, Amazon Product Description, downloaded Apr. 17, 2023, https://www.amazon.com/Birchwood-Casey-49301-Handlheld-Thrower-Right/dp/B07BS2BPFF/ref=sr_1_6?crid=2MRNEBEVUOQPN&keywords_clay_thrower . . . , 9 pages.

Caldwell Clay Launcher, Model 505501, Catalog Description, downloaded Apr. 17, 2023, https://www.zoro.com/caldwell_clay_launcher-505501/i/G000911389/?utm_source=google&utm_medium=surfaces&utm_campaign=shopping . . . , 6 pages.

Champion Traps & Targets, Easybird Auto-Feed 6_Packer, Instruction Manual, Part Nos. 40911 and 40912, Not Dated, downloaded Apr. 17, 2023, www.championtarget.com, 28 pages.

Champion Traps & Targets, Flightmaster Jr., Trap Owner's Instruction Manual, Part No. 40240, Not Dated, downloaded Apr. 17, 2023, www.championtarget.com, 16 pages.

Champion Traps & Targets, High Fly Target Thrower, Assembly and Operating Instructions, Part No. 40901, Not Dated, downloaded Apr. 17, 2023, www.championtarget.com, 16 pages.

Champion Traps & Targets, High Fly Target Thrower, Part No. 40901, Catalog Description, downloaded Apr. 17, 2023, www.championtarget.com/clays-and-throwers/manual-and-stationary/high-fly-string-release-manual-trap/CH-40901.html, 3 pages.

Champion Traps & Targets, Matchbird Trap (Double & Single Versions), Owner's/Operator's Manual, Parts and Assembly Instructions, Part Nos. 40904 and 40907, Not Dated, downloaded Apr. 17, 2023, www.championtarget.com, 24 pages.

Champion Traps & Targets, Skybird Trap, Owner's/Operator's Manual, Parts and Assembly Instructions, Part No. 40903, Not Dated, downloaded Apr. 17, 2023, www.championtarget.com, 28 pages.

Champion Traps & Targets, Skybird Tripod Mount Trap, Owner's/Operator's Manual, Parts and Assembly Instructions, Part No. 40906, Not Dated, downloaded Apr. 17, 2023, www.championtarget.com, 24 pages.

Champion Traps & Targets, Skybird ¾ Cock Trap Tripod Mount Trap, Part No. 40906, Catalog Description, downloaded Apr. 17, 2023, www.championtarget.com/clays-and-throwers/manual-and-stationary/skybird-3%2F4-cock-trap-with-tri-pod-stand/CH-40906.html, 3 pages.

Champion Traps & Targets, Wheelybird 2.0 Auto-Feed Trap, Instruction Manual, Part No. 40925, Not Dated, downloaded Apr. 17, 2023, www.championtarget.com, 57 pages.

Champion Traps & Targets, Wheelybird 2.0 Auto-Feed Trap, Catalog Description, Part No. 40925, downloaded Apr. 17, 2023, https://www.championtarget.com/wheelybird-auto-feed-trap-2.0/CH-40925.html, 5 pages.

Do-All Outdoors, Auto Traps, Catalog Description, downloaded Apr. 17, 2023, https://www.doalloutdoors.com/collections/auto-traps, 4 pages.

Do-All Outdoors, Backyard ¾ Cock Single Trap Thrower, Model BY56, Operating Manual, Not Dated, downloaded Apr. 17, 2023, www.doalloutdoors.com, 4 pages.

Do-All Outdoors, Clay Cannon Clay Pigeon Handheld Skeet Clay Pigeon Thrower, Amazon Product Description, downloaded Apr. 17, 2023, https://www.amazon.com/Clay-Cannon/dp/B085NX9LZG, 7 pages.

Do-All Outdoors, Clayhawk Full Cock, Model CH300, Operating Manual, Not Dated, downloaded Apr. 17, 2023, www.doalloutdoors.com, 4 pages.

Do-All Outdoors, Double Eagle Auto Trap, Model DE2, Operating Manual, Not Dated, downloaded Apr. 17, 2023, www.doalloutdoors.com, 7 pages.

Do-All Outdoors, Double Head Full Cock Trap, Model DT500, Operating Manual, Not Dated, downloaded Apr. 17, 2023, www.doalloutdoors.com, 4 pages.

Do-All Outdoors, Firefly Auto Trap, Model FF550, Operating Manual, Not Dated, downloaded Apr. 17, 2023, www.doalloutdoors.com, 6 pages.

Do-All Outdoors, Fowl Play Auto Trap, Model FP25, Operating Manual, Not Dated downloaded Apr. 17, 2023, www.doalloutdoors.com, 6 pages.

Do-All Outdoors, The Competitor, Model CT101, Operating Manual, Not Dated, downloaded Apr. 17, 2023, www.doalloutdoors.com, 4 pages.

Do-All Outdoors, The Raven, Model RAV1, Operating Manual, Not Dated, downloaded Apr. 17, 2023, www.doalloutdoors.com, 4 pages.

(56) References Cited

OTHER PUBLICATIONS

Do-All Outdoors, USA Clay Auto Trap, Model USAAT20, Operating Manual, Not Dated, downloaded Apr. 17, 2023, www.doalloutdoors.com, 6 pages.
Ferus Outdoors, Model 21210, 21211 XT 210 ¾ Collapsible Trap Thrower Operators Manual, Not Dated, downloaded Apr. 17, 2023 , www.ferusoutdoors.com, 28 pages.
Ferus Outdoors, XT 210 ¾Collapsible Trap Thrower, Amazon Product Description, downloaded Apr. 17, 2023 , https://www.amazon.com/Ferus-Outdoors-Clay-Thrower-Collapsible/dp/BOB94M8KMQ/ref=sr_1_12?crid=2N39QATLWWKV0&keywords=clay+pigeon . . . , 7 pages.
FlurryLauncher, Simulated Game Shooting, Operator Instruction Manual, Not Dated, downloaded Apr. 17, 2023 , www.flurrylauncher.com, 2 pages.
GoSports Outdoors, Catapult-Handheld Clay Pigeon Thrower, Model GSO-CLAYTOSS-2, Amazon Product Description, Downloaded Apr. 17, 2023, www.amazon.com, 7 pages.
MEC Outdoors, Trap & Skeet Series, Catalog Descriptions, Not Dated, downloaded Apr. 17, 2023, https://www.mecoutdoors.com/trap-and-skeet-series, 3 pages.
Old Vintage Cast Iron Western Trap/Skeet Shooting Clay Pgeon Thrower, K-BID Online Auctions, Online Description, Lot #164, downloaded Apr. 17, 2023, https://www.k-bid/com/auction/34277/item/164, 4 pages.
Promatic, ISSF, Operating Instructions Pigeon-Clay Target Launcher, Version 1.4, Jun. 2022, downloaded Apr. 17, 2023, Promatic International Ltd., www.promatic.co.uk, 12 pages.
Promatic, ISSF, Routine Maintenance Pigeon-Clay Target Launcher, Version 1, Mar. 2018, downloaded Apr. 17, 2023, Promatic International Ltd., www.promatic.co.uk, 8 pages.
Promatic, ISSF, Promatic Pigeon, Catalog Description, downloaded Apr. 17, 2023, Promatic International Ltd., https://promatic.co.uk/products/promatic-pigeon, 2 pages.
Promatic, ISSF, Operating Instructions Super Hawk—Clay Target Launcher, Version 2.1, Nov. 2021, downloaded Apr. 17, 2023, Promatic International Ltd., www.promatic.co.uk, 20 pages.
Promatic, ISSF, Operating Instructions Wobble Units—Merlin & Hobby, Version 1.3, Dec. 2022, downloaded Apr. 17, 2023, Promatic International Ltd., www.promatic.co.uk, 20 pages.
Promatic, ISSF, Operating Instructions Wobble Units—Super Hawk, Version 1.6, Mar. 2019, downloaded Apr. 17, 2023, Promatic International Ltd., www.promatic.co.uk, 20 pages.
Rogers Sporting Goods, Workin' Man Trap Thrower, Catalog Description, downloaded Apr. 17, 2023, https://rogerssportinggoods.com/rogers-workin-man-trap-thrower, 4 pages.
SureThrow, Clay Target Throwers for Skeet Shotgun Shooting, Not Dated, downloaded Apr. 17, 2023, https://surethrow.com, 5 pages.
Trap Thrower, Vintage Western Hand Trap/Clay Pigeon Thrower, Item Specifications, Ebay, downloaded Apr. 17, 2023, https://www.ebay.com/itm/165762092251?hash=item269830ccdb:g:BcUAAOSwkcFbl9zp, 4 pages.
Trius Traps Instruction Manual, #10571, Rev. 0209, www.triustraps.com, Not Dated, downloaded Apr. 17, 2023, https://www.manuals/trius/trap-master/manual, 12 pages.
Vintage Remington Automatic Hand Trap Clay Pigeon Launcher c. 1950s-1960s, Item Specifications, Ebay, downloaded Apr. 17, 2023, https//www.ebay.com/itm/323762278328?_ul=IL, 3 pages.
Western Retro, Trouble Shooting, Target Flight Adjustment, and Maintenance Manual, Western Self Loading Skeet Trap, Model V1574A, Not Dated, downloaded Apr. 17, 2023, http://westernretro.net, 28 pages.
Automatic Clay Pigeon Thrower, https://www.youtube.com/watch?v=WLN3qbPA_Rc, uploaded 2016, by BYUIdahoMechatronics.
DIY Homemade Sporting Clay Rabbit Thrower Trap First Test, https://youtube.com/watch?v=FaZwaSKjz7w, uploaded Apr. 2022, by Donnie D.
Homemade Air Skeet Thrower, https://www.youtube.com/watch?v=Ct7lEUT_pl8, uploaded 2010, by Grevy 132.
Homemade Clay Pigeon Thrower, https://www.youtube.com/watch?v=JepWolrT9nc, uploaded 2023, by Meal Team Six.
The Flurry Launcher, https://www.youtume.com/watch?v=SyyhNF202W8, uploaded 2012, by Fieldsports Channel.
Champion Traps & Targets, Standard Hand Thrower, Catalog Description, downloaded Apr. 17, 2023, www.championtarget.com/clays-and-throwers/manual-and-stationary/standard-hand-thrower/CH-40915.html, 2 pages.

* cited by examiner

HANDHELD SHOOTING TARGET THROWER

CROSS-REFERENCE TO RELATED APPLICATION

The present application claims priority to U.S. Provisional Patent App. Nos. 63/266,193, filed Dec. 30, 2021, and 63/306,764, filed Feb. 4, 2022, the entireties of which are hereby incorporated by reference.

FIELD

The present disclosure generally relates to target throwers and more particularly to handheld clay target throwers.

BACKGROUND

Clay targets, also referred to as clay pigeons, are commonly used in shooting sports. Clay targets are usually thrown from some type of thrower, and a shooter attempts to shoot the target as it flies away from the thrower. Improvements on clay throwers in areas of safety, consistency, and efficiency are needed.

SUMMARY

In one aspect, a handheld clay thrower assembly for throwing a clay target comprises a frame including a shoulder rest. A thrower is supported by the frame and is moveable relative to the frame for throwing the clay target.

In another aspect, a handheld clay thrower assembly for throwing a clay target comprises a frame. A thrower is supported by the frame and is moveable from a first thrower position to a second thrower position to throw the clay target from the thrower. A firing mechanism is supported by the frame. The firing mechanism includes a release actuator and a linkage. The linkage includes first and second links. The first link is moveable relative to the second link.

In yet another aspect, a handheld clay thrower assembly for throwing a clay target comprises a frame. A thrower is supported by the frame and is moveable from a first thrower position to a second thrower position to throw the clay target from the thrower. A cocking mechanism is supported by the frame. The cocking mechanism includes a cocking actuator and a linkage. The linkage includes first and second links. The first link is moveable relative to the second link.

In yet another aspect, a handheld clay thrower assembly for throwing a clay target comprises a frame. A thrower is supported by the frame and is moveable relative to the frame. The thrower comprises a throwing arm and a clay target carriage. The clay target carriage is configured to locate the clay target relative to the thrower and to release the clay target to permit the thrower to throw the clay target. The throwing arm is moveable from a first throwing arm position to a second throwing arm position to throw the clay. The throwing arm includes a throwing arm body configured to permit the clay target to roll along the throwing arm after the clay target is released from the clay target carriage.

Other objects and features of the present disclosure will be in part apparent and in part pointed out herein.

BRIEF DESCRIPTION OF THE DRAWINGS

Corresponding reference numbers indicate corresponding parts throughout the drawings.

DETAILED DESCRIPTION

Referring to FIGS. 1-4, a handheld clay thrower assembly of the present disclosure is indicated by 10. In one example, the handheld clay thrower assembly may be used for throwing a target/pigeon, commonly used as a shotgun shooting target. A standard clay target/pigeon, indicated by letter C, is shown in the illustrated embodiment, however other size clay targets (e.g. Midi, Mini, Rabbit, Battue, etc.), and other types of targets or projectiles, can be usable with the clay thrower, or variations of the thrower, without departing from the scope of the present disclosure. The standard clay target includes an upper face, a bottom face opposite the bottom face, and a height dimension defined therebetween.

Figure 1:
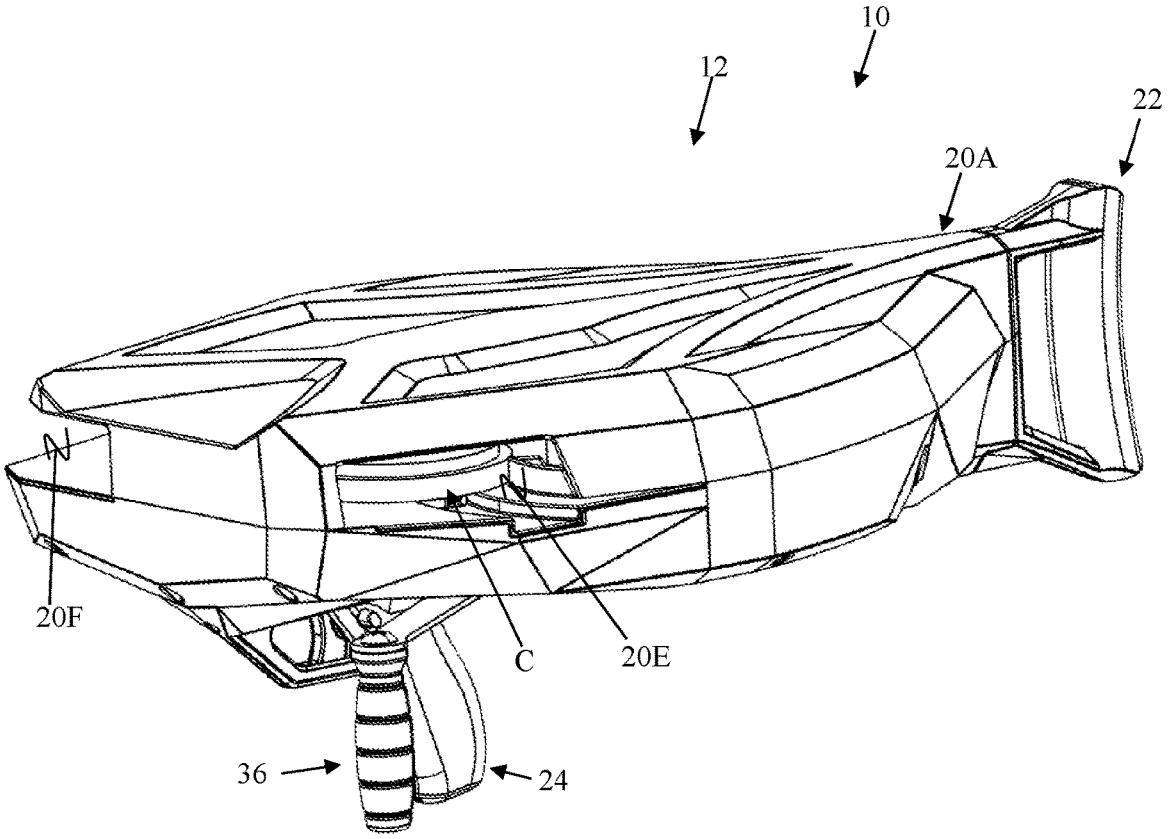
FIG. 1 is a front perspective of a clay thrower assembly.
Figure 2:
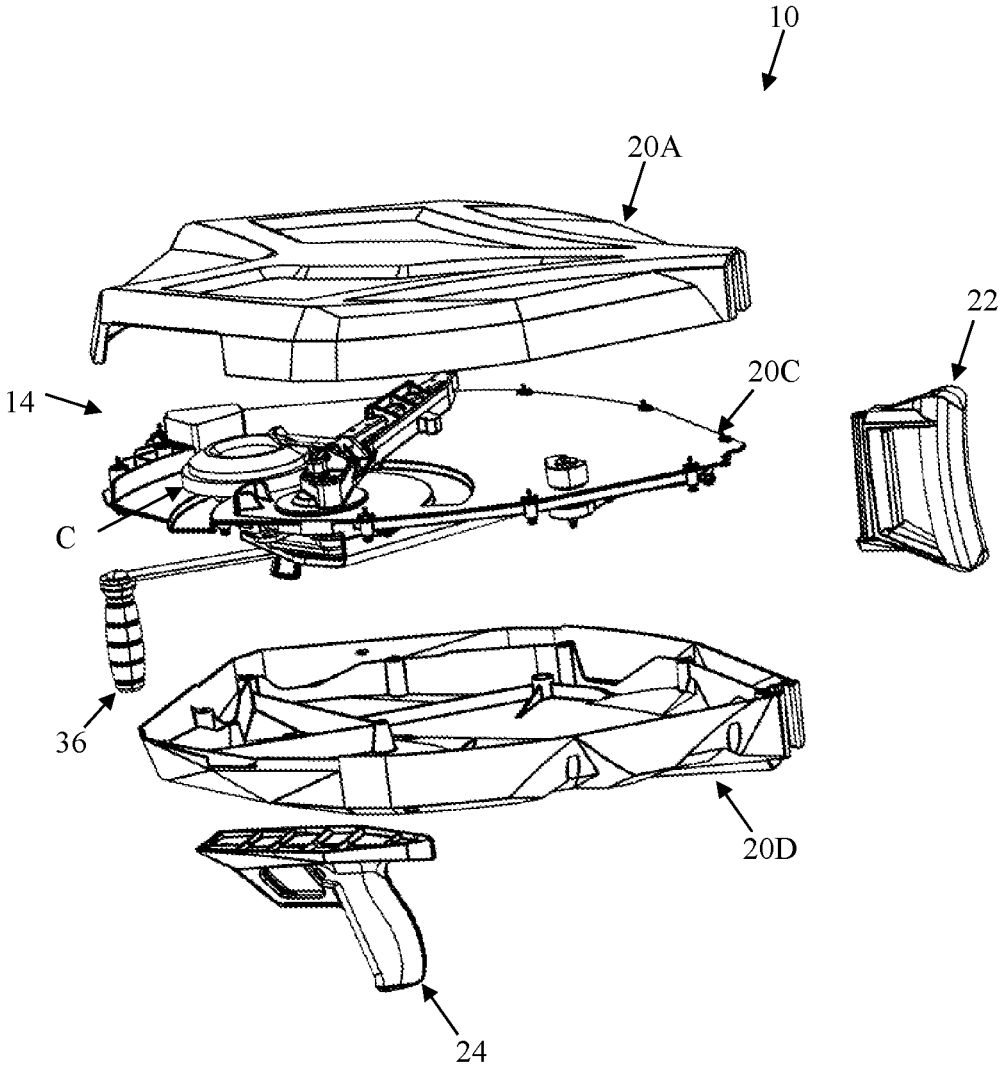
FIG. 2 is an exploded perspective of the clay thrower assembly.

The handheld clay thrower assembly 10 comprises a frame 12 and a thrower 14 (FIG. 2). As will be described in greater detail herein, the frame 12 is configured for supporting a cocking mechanism 16 (FIG. 7), and a firing/release mechanism 18 (FIG. 8), each being operatively connected to the thrower 14.

Figure 3:
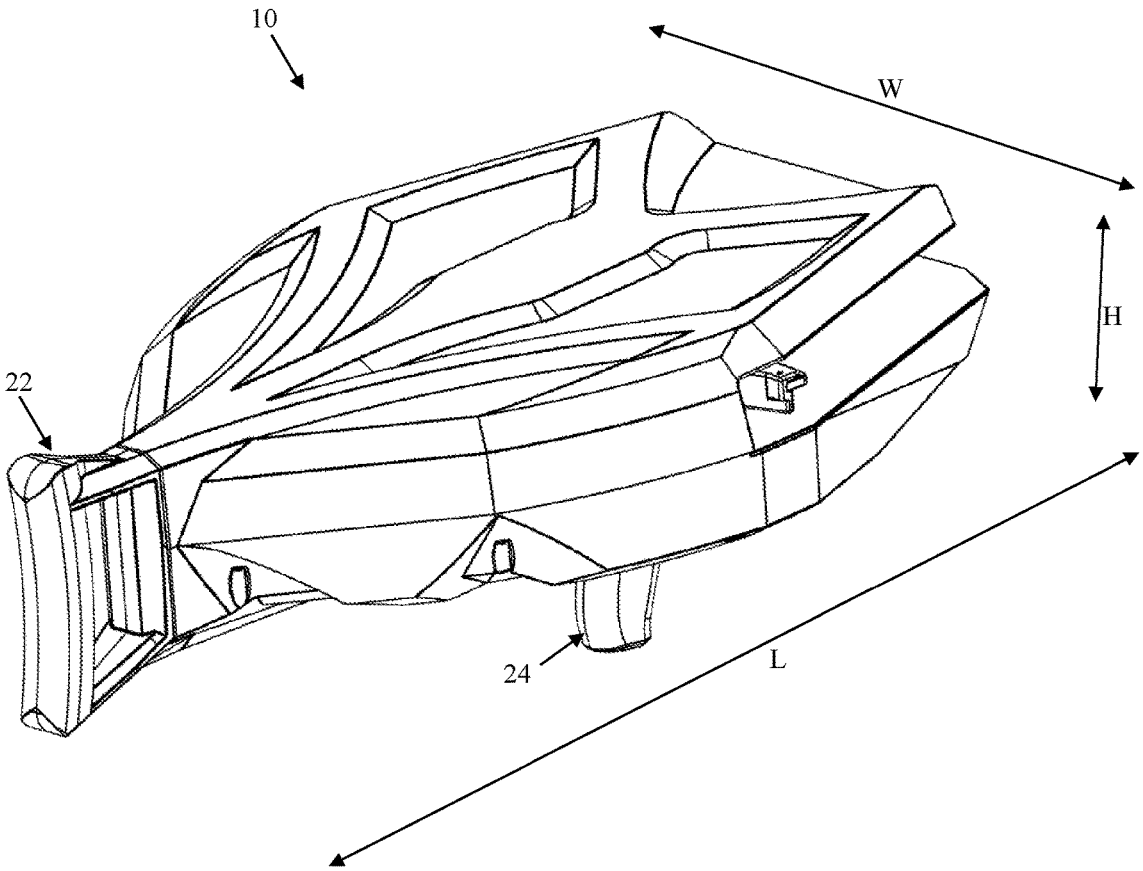
FIG. 3 is a rear perspective of the clay thrower assembly.

Referring to FIG. 2, the frame 12 includes a housing assembly, a shoulder rest 22, and a front handle 24. The housing assembly comprises a housing 20A including an upper shell portion 20B, a lower shell portion 20D, and a support body 20C arranged therebetween. The support body 20C includes a generally planar support surface. A lower compartment is defined by a space between the support body 20C and lower shell portion 20D. An upper compartment is defined by a space between the support body 20C and the upper shell portion 20B. The cocking and firing mechanisms 16,18 are arranged in the lower compartment, and the thrower is arranged in the upper compartment. Referring to FIG. 3, the housing 20A includes a rear end and a front end forward of the rear end, defining a length L dimension therebetween; a left side and a right side defining a width W dimension therebetween; and a top side and a bottom side defining a height H dimension therebetween. The left side of the housing 20A faces out of the page in FIG. 1, and the right side of the housing faces out of the page in FIG. 3. In the illustrated embodiment, the width W dimension is greater than the height H dimension for allowing the thrower to move in its throwing motion, as will become apparent. The housing includes an inlet (first) opening 20E arranged on the left side of the housing configured for receiving a clay C from the user. An outlet (second) opening 20F is arranged at the front of the housing where the clay C exits in a generally forward direction. Other configurations can be used without departing from the scope of the present disclosure.

The shoulder rest 22 is positioned at the rear end of the housing and is configured to rest in a shoulder pocket of a user. The width W of the housing tapers, or narrows, in the direction of the shoulder rest 22 so the housing 20A does not interfere with the user's arm and/or body as the user shoulders and aims the clay thrower 10. Moreover, the top side of the housing is generally flat so to not interfere with the user's line of sight when aiming and firing the clay thrower. In the illustrated embodiment, the shoulder rest 22 includes a shoulder body which defines a cavity to form a handle sized and shaped for receiving a hand of the user to assist the user in carrying the clay thrower. In the illustrated embodiment, the shoulder rest 22 is connectable to the housing by a dovetail connection and a fastener. Other ways of connecting the shoulder rest to the housing are not outside the scope of this disclosure. Moreover, the shoulder rest can be integrally formed with the housing and can be omitted.

Referring to FIGS. 2 and 3, the front handle 24 comprises a handle assembly including a gripping portion, a trigger guard, and a safety mechanism. The front handle is positioned forward of the shoulder rest 22 and is configured to assist the user in grasping and firing the clay thrower. The front handle 24 is supported by the bottom side of the housing allowing for the user's arm/forearm to further support the clay thrower 10 as the user fires the clay thrower. In the illustrated embodiment, the gripping portion is configured to replicate a pistol grip of a firearm. The trigger guard is configured to guard a trigger 26 (broadly, release actuator), as will be described in greater detail below. The safety mechanism includes a safety button (broadly, "actuator") pressable by the user to move in and out of the way of the trigger to prevent or permit the trigger to be actuated.

Referring to FIGS. 6, 7, and 9-11, the thrower 14 comprises a throwing arm 28 supported by and moveable with respect to the support body 20C. The throwing arm 28 includes a throwing arm body having a proximal end and a distal end. The proximal end of the throwing arm is operatively connected to the cocking mechanism 16 via an output shaft. The output shaft defines a throwing arm pivot axis, TAPA. A keeper 30 extends from a rear side of the throwing arm and is configured to lockably engage a latch 32 (broadly, "retainer"). The latch 32 is operatively connected to the firing mechanism 18 and is moveable with respect to the support body 20C, as will be described in greater detail herein. In the illustrated embodiment, the keeper 30 and the latch 32 each include cam surfaces configured to cam over each other to form a locking engagement. In the illustrated embodiment, the keeper 30 is arranged toward the distal end of the throwing arm, and the latch 32 is arranged to intersect the arcuate path thereof. Other arrangements are not outside the scope of this disclosure.

Figure 7:
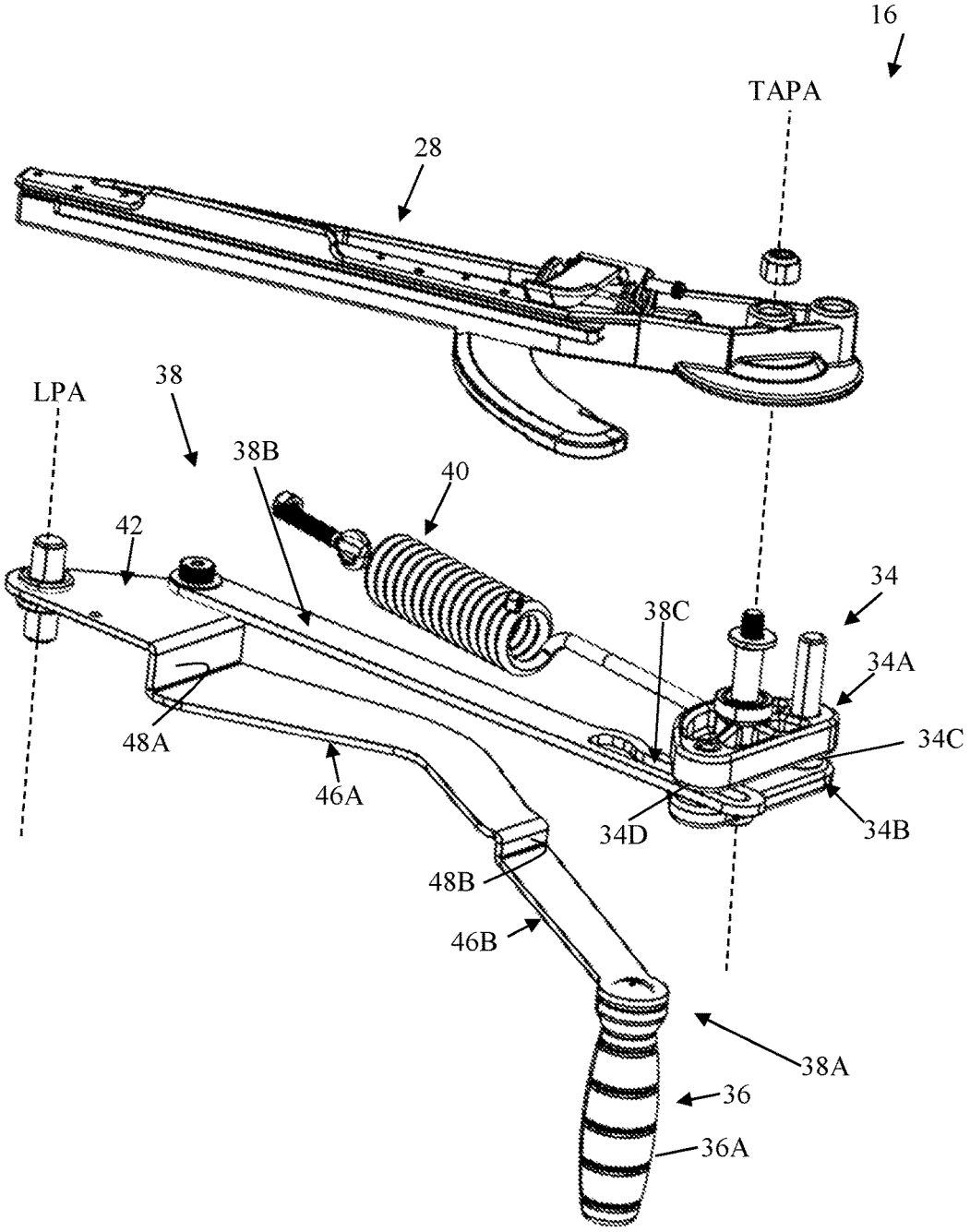
FIG. 7 is a perspective of a cocking mechanism and the throwing arm.
Figure 9:
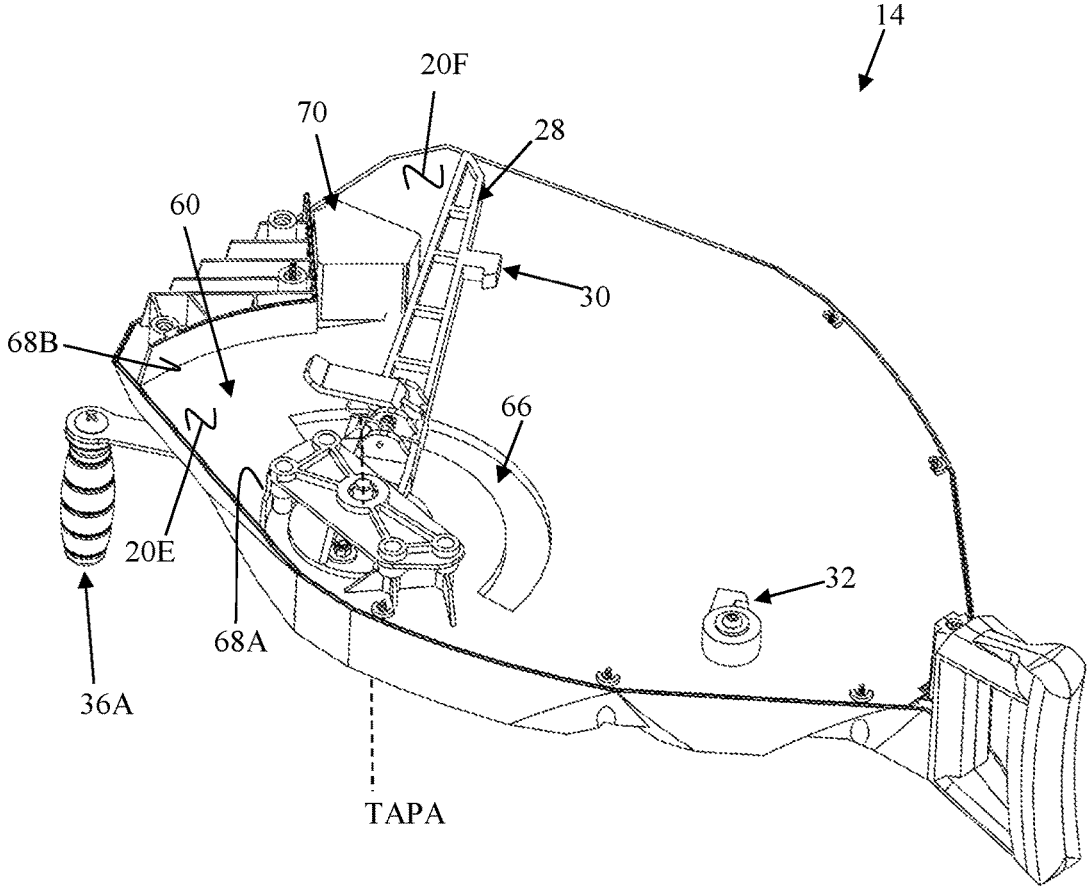
FIG. 9 is a perspective of a cocking actuator in an non-cocking position and the throwing arm in an at rest position.
Figure 10:
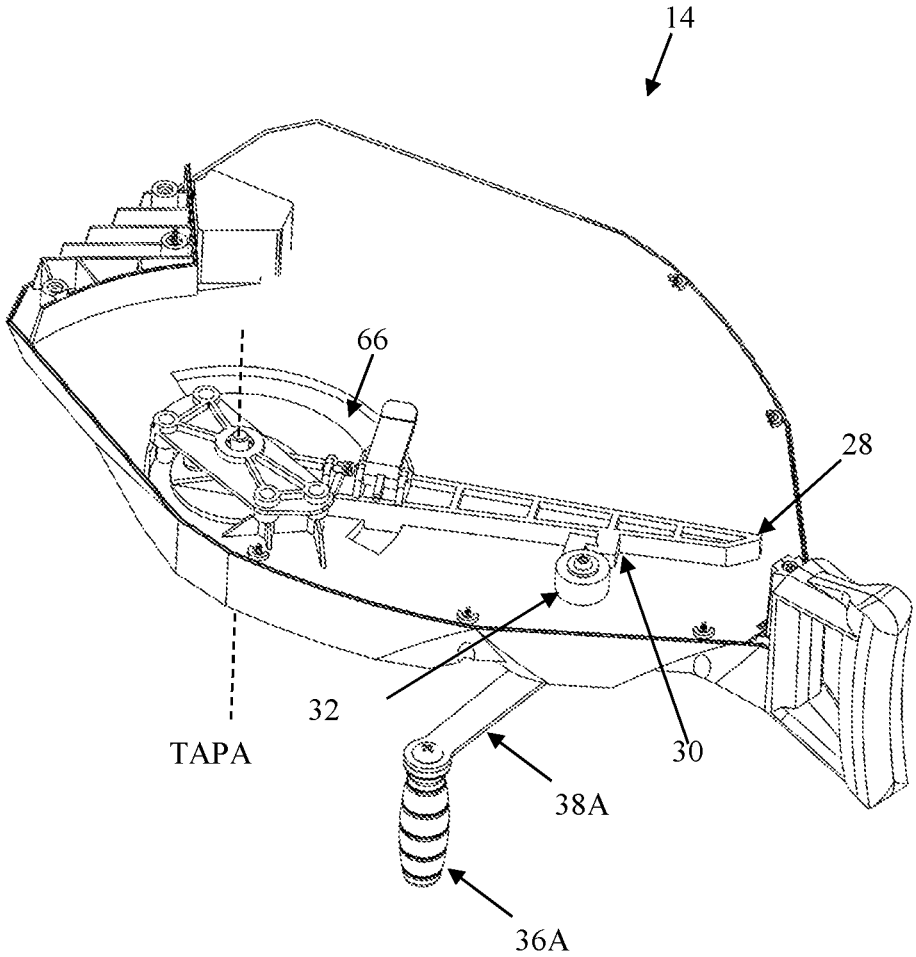
FIG. 10 is a perspective of the cocking actuator in a cocking position and the throwing arm in a cocked position.

Referring to FIG. 7, the cocking mechanism 16 is configured to rotate the throwing arm 28 from an at rest (uncocked) position (FIG. 9) to a cocked position via the output shaft (FIG. 10). The cocking mechanism 16 comprises a pivot hub 34, a cocking actuator 36 and a linkage 38. The pivot hub 34 comprises a cam assembly including an upper (first) cam member 34A, a lower (second) cam member 34B, first and second connector pins 34C, 34D (broadly, coupler). The output shaft of the throwing arm is operatively connected to the pivot hub. The upper and lower cam members 34A, 34B are spaced apart to provide a space for receiving linkage connectors.

A main spring 40 is configured to provide kinetic energy, or spring tension, to the cocking mechanism 16 and to the throwing arm 28. The main spring 40 has first end having a first spring connector, a second end having a second spring connector, and the spring body therebetween. The first spring connector is a hook configured to connect to the housing and the second spring connector is a hook configured to connect to the first connector pin 34C of the cam assembly. In the illustrated embodiment of FIGS. 5 and 7, a nut and a bolt connect the hook to the housing.

The linkage comprises a lever 38A (first link) operatively connected to a pull rod 38B (second link). The lever 38A is configured to pivot about a lever pivot axis LPA between a forward (first) position (FIGS. 9 and 11) and a rearward (second) position (FIG. 10).

Figure 5:
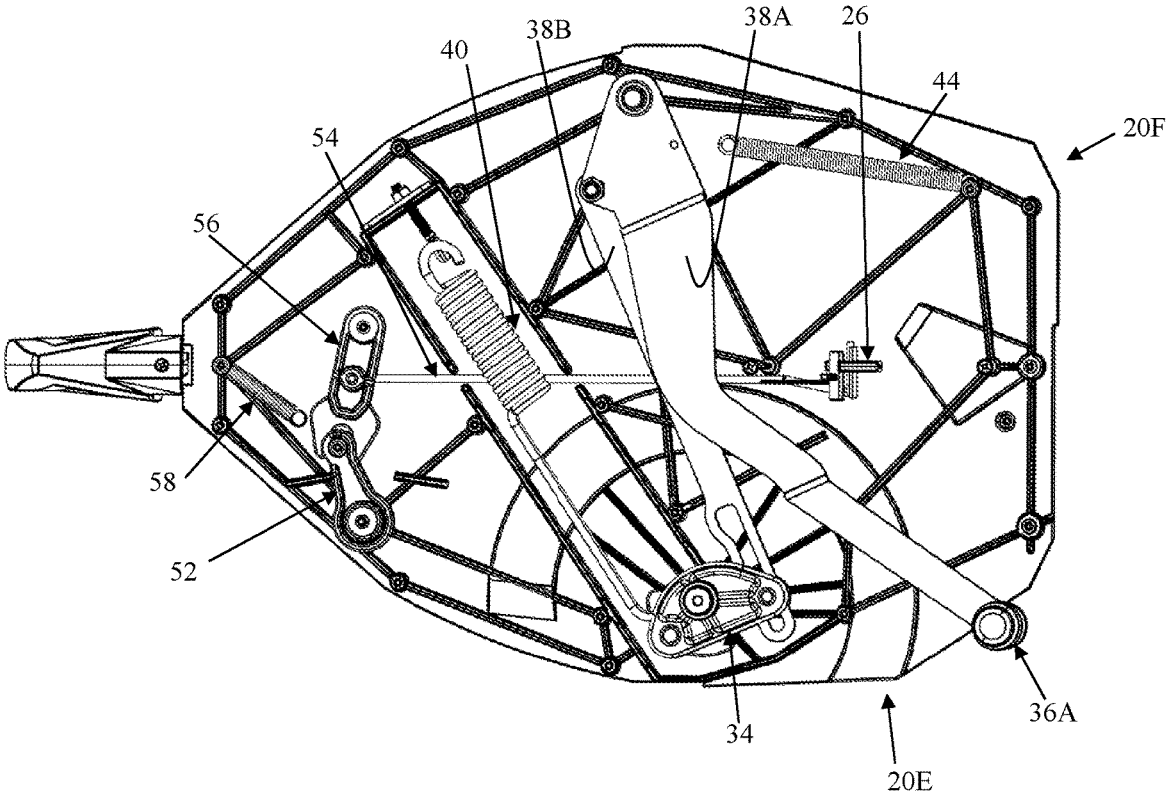
FIG. 5 is a bottom view of the clay thrower assembly with a lower housing shell portion removed.

Referring to FIG. 7, the lever 38A comprises a lever body including a proximal (first) end portion and a distal (second) end portion. The proximal end portion includes a mounting bracket 42 configured for operatively mounting the lever 38A to the support body. A pivot pin pivotably connects the lever to the support body and defines the lever pivot axis LPA. A lever spring 44 (FIG. 5) has a first end connected to the housing and a second end connected to the bracket 42 for biasing the lever 38A toward the forward position. Although FIG. 5 shows the lever spring 44 disconnected from the lever 38A, it will be understood that in use the spring is connected thereto (e.g., by reception of a hook of the spring in an opening of the lever). In the illustrated embodiment, the lever pivot axis LPA and the throwing arm pivot axis TAPA are located on opposite sides of the housing to provide mechanical advantage as the lever is actuated by the user.

Figure 4:
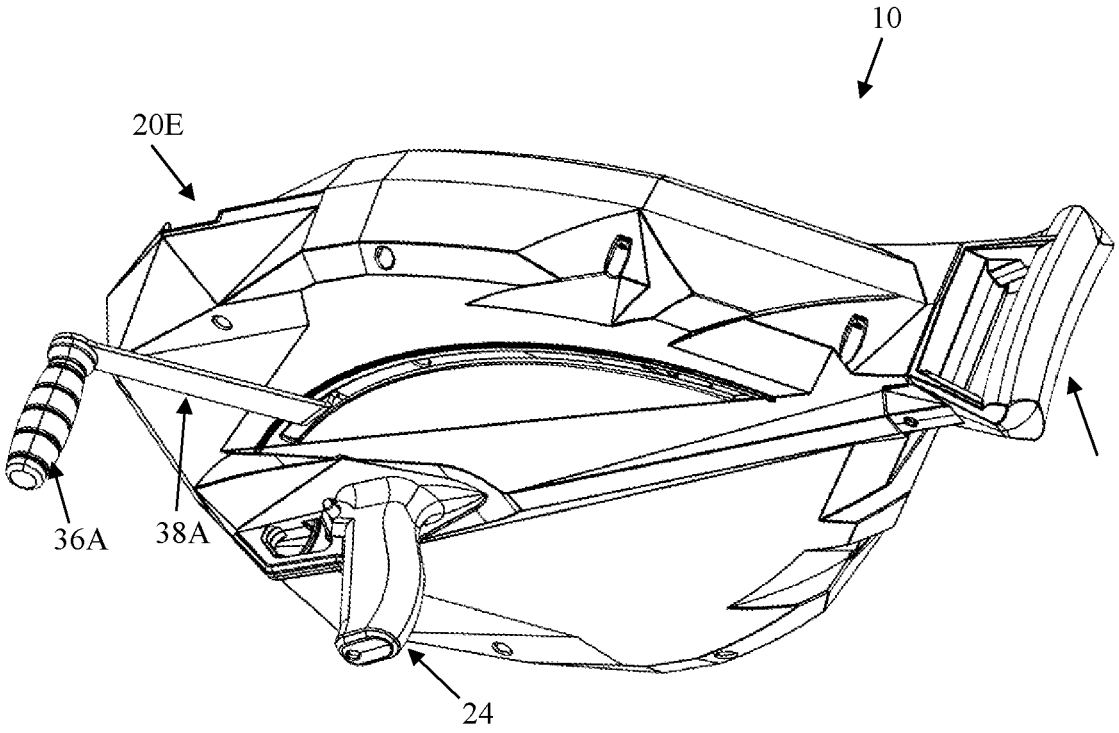
FIG. 4 is a bottom perspective of the clay thrower assembly.

As shown in FIG. 7, the lever body includes first and second segments 46A, 46B and first and second jogs 48A, 48B. In the illustrated embodiment, the first jog 48A extends downward from a distal end of the bracket 42. The first segment 46A is curved and extends distally from the first jog 48B. An elbow assists in curving the first segment 46A forward. The second jog 48B extends downward from the distal end of the first segment 46A. The second segment 46B is generally linear and extends distally from the second jog 48B. The configuration is such that the first and second segments 46A, 46B and the first and second jogs 48A, 48B permit the lever to not interfere with other components of the cocking and/or firing mechanisms when moving between the forward and rearward positions. The cocking actuator 36 includes a handle 36A connected to the distal end of the second segment. Referring to FIG. 4, the lower shell portion 20D defines an arcuate slot from which the second jog protrudes, which allows the second segment of the lever to extend outboard of the housing. As will become apparent, as the user pulls the handle 36A between the forward and rearward positions, the lever 38A is movable forward and backward along the slot.

Figure 11:
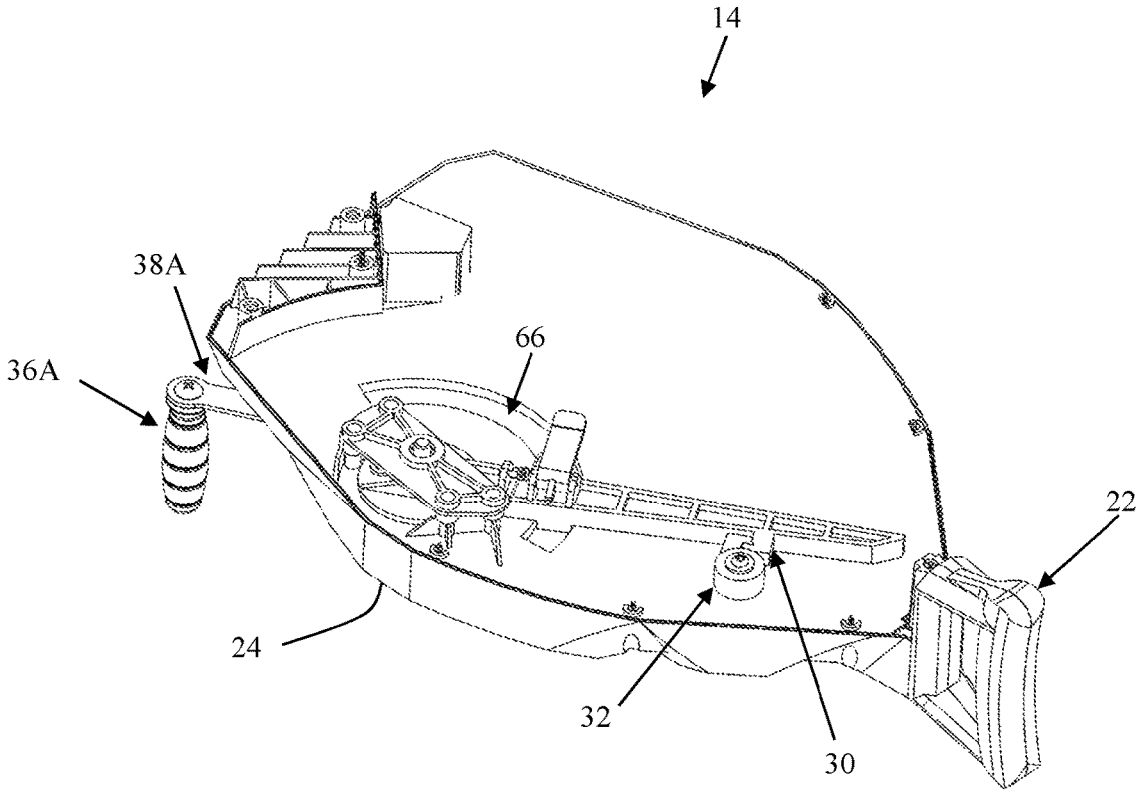
FIG. 11 is a perspective similar to FIG. 10, but the cocking actuator is returned to the non-cocking position.

The pull rod 38B includes a pull rod body including a proximal (first) end portion and a distal (second) end portion. The proximal end portion of the pull rod is pivotably connected to the bracket 42 using a fastener and a nut. The distal end portion includes a connector configured to couple with the second connector 34D of the cam assembly. In the illustrated embodiment, the connector comprises a pull slot 38C defined by the distal end portion of the pull rod. The pull slot 38C is configured to permit the lever 38A to return to the forward position after cocking the throwing arm, (e.g., see FIG. 11), as will be described in greater detail below. The pull slot 38C includes a neck portion toward the distal end of the pull rod and a head portion proximal of the neck portion. The neck portion is slightly narrower relative to the head portion. The pull rod 38B moves generally width-wise (i.e. left and right) in response moving the lever 38A between the generally lengthwise between the forward and rearward positions. As the handle 36A is pulled rearward (generally into the page and to the right, as viewed from FIG. 7), the pull rod 38B is moved rightward (generally into the page and to the left, as viewed from FIG. 7) and the pull slot connector bottoms out and engages the second connector 34D of the cam assembly which rotates the cam causing the first connector 34C to move in an opposite direction to tension the main spring 40, and thus bias the throwing arm 28. Eventually, the keeper 30 lockably engages the latch 32 to lock the throwing arm in its cocked position. The pull slot 38C permits the handle 36A to be returned to the forward position (i.e., make a return stroke), such as shown by comparison of (FIGS. 10 and 11). At the end of the return stoke, the second connector 34D of the cam assembly will be seated in the head portion of the pull slot 38C and the neck of the pull slot is arranged outboard of the cam assembly. The return stoke provides an added safety feature because it allows the clay to be fired without the handle 36A violently moving forward under force of the main spring accelerating the throwing arm. Moreover, the handle 36A in its returned position can provide a third point of contact to the user, in addition to the shoulder rest and the forward handle. Other configurations can be used without departing from the scope of the present disclosure.

Figure 8:
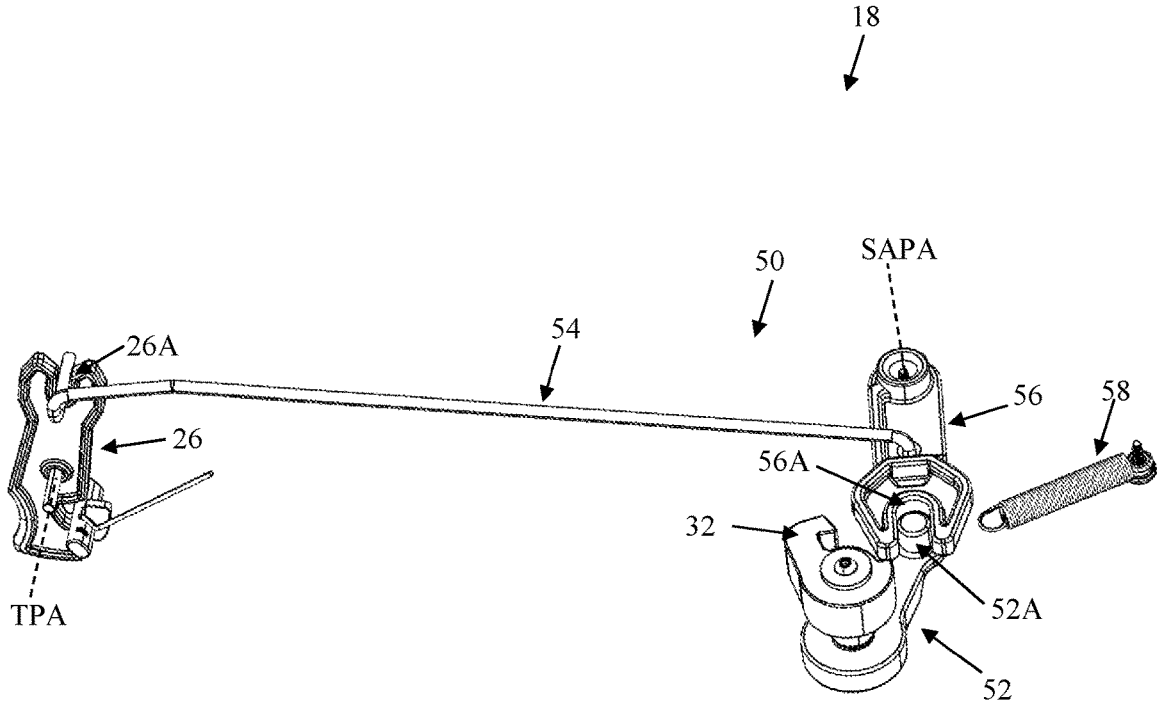
FIG. 8 is a perspective of a firing mechanism of the clay thrower assembly.

Referring to FIGS. 5 and 8, the firing mechanism 18 is configured to fire/release the throwing arm 28 from the cocked position, which in turn throws the clay pigeon. The firing mechanism 18 comprises the trigger 26 (broadly, firing actuator) and a linkage 50. The linkage includes a first arm 52 (first link) and a pull rod 54 operatively connected to a second arm 56 (together, second link). The first arm 52 includes an arm body having a proximal end and a distal end. The proximal end includes an output shaft operatively connected to the latch 32. The distal end includes a pin 52A for coupling to the second arm. A first arm spring 58 includes a first end connector connected to the housing and a second end connector connected to the first arm 52 for biasing the first arm rearward such that the latch is biased to the locked or retained position. The spring 58 also sets, or tensions, the trigger 26 in response to moving the handle 36A to the rearward position, as will be described in greater detail below. The second arm 56 includes an arm body having a proximal end and a distal end. The proximal end is pivotable about a second arm pivot axis SAPA. The distal end includes a fork defining a slot 56A. The slot 56A is configured for coupling to the pin 52A of the first arm 52. The pull rod 54 includes a front (first) end, rear (second) end, and a pull rod body therebetween. The rear end of the pull rod is connected to the second arm 56 and the front end of the pull rod is operatively connected to the trigger 26. The trigger 26 is housed within the front handle 24 and is moveable about a pin that defines a trigger pivot axis TPA. The trigger 26 includes a finger bed configured for receiving a fingertip of the user. The finger bed is arranged below the trigger pivot axis TPA and is outboard of the housing (i.e. bounded by the trigger guard) for access by the user. Above the trigger axis, the trigger includes slot 26A (broadly, connector) configured to couple to the front end of the pull rod. The arrangement is such that as the user pulls the trigger 26, the trigger pivots (counterclockwise, as viewed from FIG. 8) about the trigger pivot axis TPA, which causes the pull rod 54 to move forward, which causes the second arm 56 to pivot (clockwise) about the second arm pivot axis SAPA, which causes the first arm 52, and thus the latch 32, to pivot forward (counterclockwise) to unlatch from the keeper 30. The trigger includes a notch for receiving a safety pin configured to block or unblock from being actuated. Other ways of coupling the first and second arms and other ways of coupling the trigger to the pull rod are not outside the scope of this disclosure. The terms clockwise and counterclockwise are used with respect to the orientation of the firing mechanism as shown in FIG. 8.

A reverse sequence takes place to set/tension the trigger in response to the keeper and latch forming the locking engagement, as best illustrated in FIGS. 10 and 11.

Figure 6:
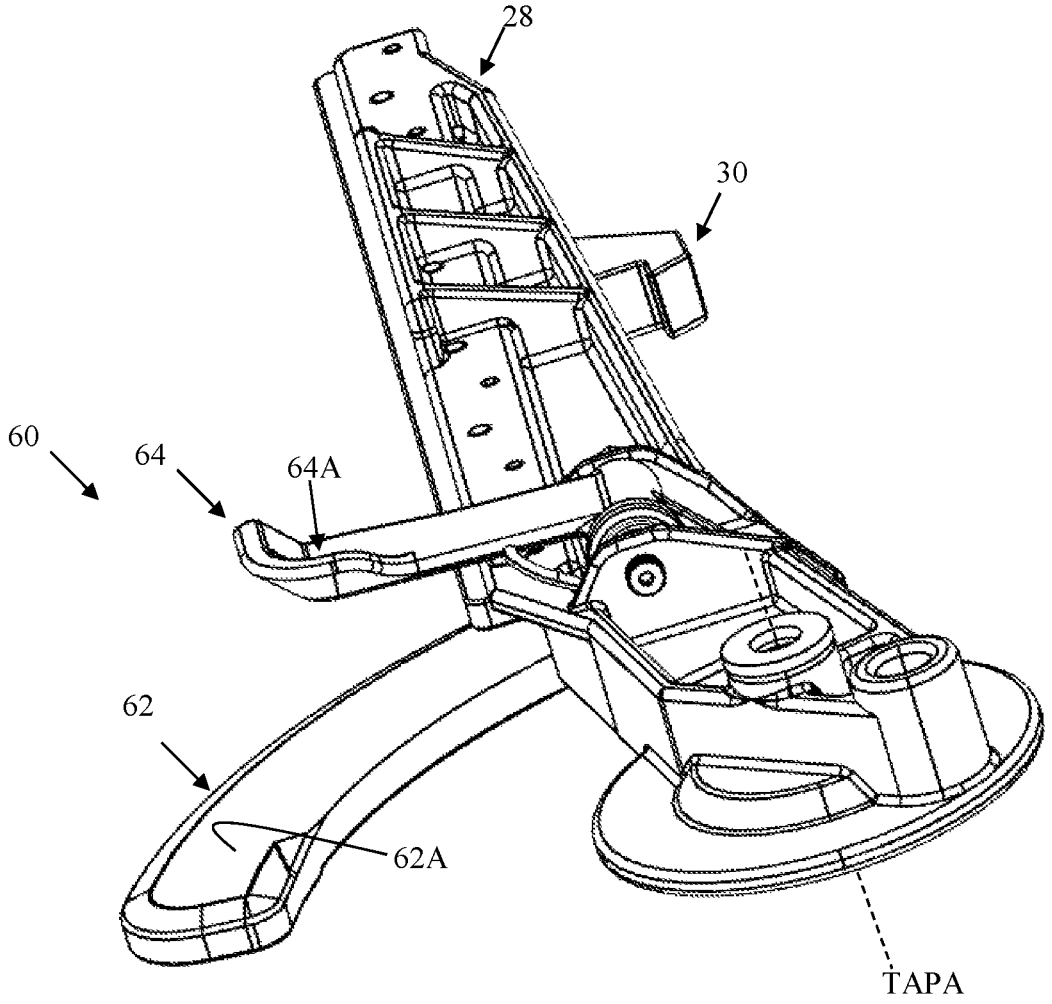
FIG. 6 is a perspective of a throwing arm of the clay thrower assembly.

Referring to FIGS. 6 and 9, the thrower comprises a carriage 60 sized, shaped, and arranged to be in registration with the inlet opening 20E when the throwing arm 28 is in the at rest position. The configuration allows a user to insert a clay pigeon in a sideways direction into the carriage prior to cocking and firing. In the illustrated embodiment, the carriage 60 is configured to hold and position the clay for firing. Upon firing, the carriage is configured to release the clay for riding along the throwing arm for being thrown, as will be described in greater detail below. It will be appreciated that the clay is arranged near the proximal end of the throwing arm when the throwing arm is in the cocked position.

The carriage 60 comprises a bed 62 and a target holder 64. In the illustrated embodiment, the bed 62 includes an arcuate body protruding from the throwing arm 28. The arcuate body is sized and shaped to move within an arcuate track 66 (broadly, recess) defined by the support body.

An upper face 62A of the bed is slightly proud (raised above) of the upper surface of the support body to reduce friction between the bottom surface of the clay pigeon C and the surface of the support body. A tip of the bed includes a chamfered edge to facilitate insertion of the clay to the carriage. The clay can cam against the chamfered edge to facilitate insertion of the clay into a space between the bed 62 and the holder 64. In the illustrated embodiment, the arc-length of the bed 62 is slightly greater than the diameter of a clay pigeon C. The configuration is such that the clay pigeon can fully rest on the bed 62 as the throwing arm is moved to the cocked position. The bed and the track may provide further stability and guidance to the throwing arm during the throwing arm motion. Other configurations can be used without departing from the scope of the present disclosure.

Figure 6A:
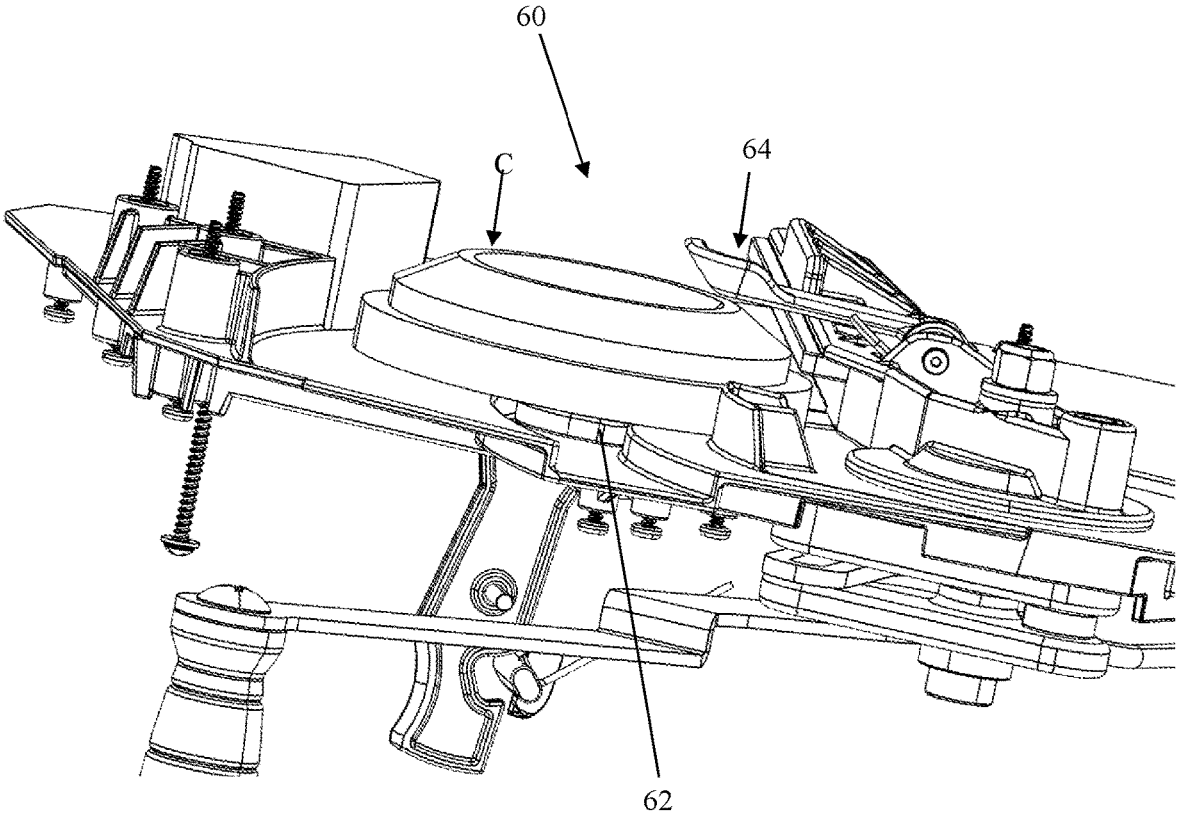
FIG. 6A is a side elevation of a carriage of the clay thrower assembly.

Referring to FIG. 6A, the target holder 64 is positioned over the bed 62 and configured to assist the bed 62 in moving the clay pigeon C as the throwing arm 28 is moved to the cocked position. The target holder 64 comprises a spring biased thumb 64A having a thumb body including a proximal end and a free distal end. The proximal end of the thumb 64A is pivotably connected to the proximal end of the throwing arm 28. The spring biases the thumb such that the thumb is pivotable between at rest and deflected positons. The thumb distal end includes a thumb tip and a gripping surface. The thumb tip has a cam/chamfered surface to facilitate insertion of the clay pigeon C. The target holder 64 is moveable from the at rest to the deflected positon in response to the user inserting a clay into the carriage. In the illustrated embodiment, proximal and distal loading guides 68A, 68B (FIG. 9) bound a passage to the carriage to further facilitate insertion of the clay. In the illustrated embodiment, an angle of the chamfer of the thumb tip is configured to correspond with the angle of a top portion of a standard clay pigeon.

The thrower includes a foam block 70 (broadly, stop or cushion) configured to stop the throwing arm 28 at the end of its movement. In the illustrated embodiment, the foam block 70 extends from the distal loading guide 68A. The size, shape, and arrangement of the foam block 70 assists in registering the carriage 60 with the inlet opening 20E. The block 70 is located between the target inlet opening 20E and the target exit opening of the housing.

Referring to FIGS. 9-11, in a cycle of use, the handle 36A begins in the forward position and the carriage 60 is in registration with the inlet opening 20E, (FIG. 9). The user may insert a clay C into the carriage in a sideways direction. The user may then pull the handle 36A to the rearward position, referred to as the first stroke (FIG. 10). As the handle 36A is pulled to the rearward position, the carriage 60 and the throwing arm 28 conjointly rotate about the throwing arm pivot axis TAPA until the keeper 30 and the latch 32 form the locking engagement. The locking engagement sets/tensions the trigger 26, so the clay could be thrown after the first stroke. However, prior to firing, the user may make the return stroke of the handle 36A to the forward position (FIG. 11). The return stroke is provided by the pull slot, as described above. If the user has not already shouldered the thrower assembly, the user may arrange the shoulder rest 22 into the user's shoulder pocket to aim the clay thrower and arrange a right (first) hand on the front handle 24, and a left (second) hand on the handle 36A. The user may pull the trigger 26 to fire the clay C. In response to the trigger being pulled, the latch 32 unlatches from the keeper 34 thereby releasing the throwing arm. As the throwing arm is rotating about the throwing arm pivot axis TAPA, a centrifugal force assists in dislodging the clay C from the carriage 60 and causes the clay C to slide along and/or roll along the front edge of the throwing arm 28. At some point, the clay C exits the outlet opening 20F and the throwing arm 28 hits the foam block 70 (FIG. 9), at which point the carriage 60 is back in registration with the inlet opening 20E and the user may load a new clay and repeat the cycle.

It will be apparent that modifications and variations are possible without departing from the scope of the invention defined in the appended claims. The dimensions and proportions described herein are by way of example without limitation. Other dimensions and proportions can be used without departing from the scope of the present disclosure.

As various changes could be made in the above constructions and methods without departing from the scope of the invention, it is intended that all matter contained in the above description and shown in the accompanying drawings shall be interpreted as illustrative and not in a limiting sense.

It will be apparent that modifications and variations are possible without departing from the scope of the invention defined in the appended claims. The dimensions and proportions described herein are by way of example without limitation. Other dimensions and proportions can be used without departing from the scope of the present disclosure.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A handheld clay thrower assembly for throwing a clay target, the clay target having an upper face, a bottom face, and a sidewall therebetween, the handheld clay thrower assembly comprising:

a frame;

a thrower supported by the frame and moveable relative to the frame, the thrower comprising a throwing arm and a clay target holder, the clay target holder being configured to engage the upper face of the clay target to locate the clay target relative to the thrower, the clay target holder being configured to release the clay target to permit the thrower to throw the clay target, the throwing arm being moveable from a first throwing arm position to a second throwing arm position to throw the clay, the throwing arm including a throwing arm body configured to permit the clay target to roll along the throwing arm after the clay target is released from the clay target holder; and a bumper supported by the frame and arranged to engage the throwing arm to position the throwing arm at the second throwing arm position.

2. The handheld clay thrower assembly of claim 1, wherein the clay target holder is configured to move with the throwing arm as the throwing arm moves from the first throwing arm position to the second throwing arm position.

3. The handheld clay thrower assembly of claim 1, wherein the clay target holder is configured to grip the clay target to locate the clay target relative to the throwing arm and is configured to release the clay target responsive to movement of the throwing arm toward the second throwing arm position.

4. The handheld clay thrower assembly of claim 3, wherein the clay target holder is moveable between an at rest position and a deflected position, the clay target holder being biased toward the at rest position.

5. The handheld clay thrower assembly of claim 4, wherein the clay target holder is moveable from the at rest position to the deflected position by engagement of the clay target with the clay target holder.

6. The handheld clay thrower assembly of claim 1, wherein the clay target holder is configured to be located to be accessible by a user to load the clay target to the clay target holder when the throwing arm is in the second throwing arm position.

7. The handheld clay thrower assembly of claim 1, wherein the clay target holder is configured to receive the clay by sideways movement of the clay sidewall relative to the clay target holder.

8. The handheld clay thrower assembly of claim 1, wherein the frame includes a support surface arranged to support the clay target as the clay target rolls along the throwing arm, the clay target holder being moveable relative to the support surface.

9. The handheld clay thrower assembly of claim 8, wherein the clay target holder is biased toward the support surface.

10. The handheld clay thrower assembly of claim 9, wherein the support surface and the clay target holder are configured to grip the clay in a space between the support surface and the clay target holder.

11. The handheld clay thrower assembly of claim 1, further comprising a support surface, the clay target holder being resiliently deflectable away from the support surface for gripping the clay.

12. The handheld clay thrower assembly of claim 1, further comprising a latch configured to engage the throwing arm to retain the throwing arm in the first throwing arm position.

13. The handheld clay thrower assembly of claim 12, further comprising a trigger actuatable to permit the thrower to throw the clay target, and wherein the trigger is forward of the latch.

14. The handheld clay thrower assembly of claim 1, further comprising a firing mechanism supported by the frame, the firing mechanism including a release actuator, a linkage, and a latch configured to engage the throwing arm to retain the throwing arm in the first throwing arm position, the linkage coupling the release actuator to the latch so that movement of the release actuator results in movement of the latch to release the throwing arm to permit the throwing arm to move to the second throwing arm position to throw the clay target.

15. The handheld clay thrower assembly of claim 14, wherein the release actuator is located in front of the latch.

16. The handheld clay thrower assembly of claim 15, wherein the release actuator comprises a trigger.

17. The handheld clay thrower assembly of claim 1, wherein the frame includes a downwardly extending pistol grip.

18. The handheld clay thrower assembly of claim 17, further comprising a trigger actuatable to permit the thrower to throw the clay target, the trigger being arranged relative to the pistol grip so that the trigger is engageable by a hand of a user when the hand of the user is grasping the pistol grip.

19. The handheld clay thrower assembly of claim 1, further comprising a trigger actuatable to permit the thrower to throw the clay target and a support surface arranged to support the clay target, the trigger being disposed below the support surface.

20. The handheld clay thrower assembly of claim 1, wherein the frame includes a first downwardly extending handle sized and shaped to be grasped by a first hand of a user to support a weight of the handheld clay thrower assembly while the user controls the handheld clay thrower assembly to throw the clay target.

21. The handheld clay thrower assembly of claim 20, further comprising a trigger actuatable to permit the thrower to throw the clay target, the trigger being arranged relative to the first handle so that the trigger is engageable by the first hand of the user when the first hand of the user is grasping the first handle.

22. The handheld clay thrower assembly of claim 20, wherein the frame includes a second handle sized and shaped to be grasped by a second hand of the user to support the handheld clay thrower assembly.

23. The handheld clay thrower assembly of claim 22, wherein the second handle is rearward of the first handle.

24. The handheld clay thrower assembly of claim 23, wherein the first handle comprises a pistol grip.

25. The handheld clay thrower assembly of claim 1, wherein the frame is handheld and includes at least one handle at a bottom end of the frame for permitting a user to carry the handheld clay thrower assembly while operating the handheld clay thrower assembly to throw the clay target.

26. The handheld clay thrower assembly of claim 1, wherein the clay target holder is moveable between a first position and a second position relative to the throwing arm.

27. The handheld clay thrower assembly of claim 1, wherein the frame includes a housing, and the thrower moves within the housing.

28. The handheld clay thrower assembly of claim 27, wherein the housing defines an inlet opening along a side of the housing to receive the clay by sideways movement of the clay target.

29. The handheld clay thrower assembly of claim 1, wherein the clay target holder comprises a thumb and a spring, the thumb pivotally connected to the throwing arm between an at rest position and a deflected position, the spring biasing the thumb toward the at rest position.

30. The handheld clay thrower assembly of claim 1, wherein the clay target holder comprises a thumb and a spring, the thumb having a proximal end portion and a distal end portion opposite the proximal end portion, wherein the proximal end portion of the thumb is pivotably connected to the throwing arm and the distal end portion includes a surface arranged to engage the upper face of the clay target, the spring being connected to the thumb and biasing the thumb to pivot toward an at rest position of the thumb.

* * * * *